United States Patent [19]

Bornhorst

[11] Patent Number: 4,701,833

[45] Date of Patent: Oct. 20, 1987

[54] VENTILATION SYSTEM FOR STAGE LIGHT INSTRUMENT

[75] Inventor: James M. Bornhorst, Duncanville, Tex.

[73] Assignee: Vari-Lite, Inc., Dallas, Tex.

[21] Appl. No.: 887,371

[22] Filed: Jul. 16, 1986

[51] Int. Cl.[4] ..... F21V 29/00

[52] U.S. Cl. ..... 362/299; 362/218; 362/373; 362/426

[58] Field of Search ..... 362/294, 218, 217, 370, 362/373, 404, 417, 426; 353/57-61, 119

[56] References Cited

U.S. PATENT DOCUMENTS

| | | | |
|---|---|---|---|
| 1,301,994 | 4/1919 | Archer et al. | 362/426 |
| 1,879,600 | 9/1932 | Burchelt | 353/57 |
| 1,977,883 | 10/1934 | Levy | 362/426 X |
| 2,108,052 | 2/1938 | Eitzen | 353/57 X |
| 2,614,457 | 10/1952 | Weber | 353/119 |
| 3,180,981 | 4/1965 | Ulffers | 353/61 X |
| 3,298,277 | 1/1967 | Scharf | 353/59 X |
| 3,959,644 | 5/1976 | Dammel | 240/47 |

*Primary Examiner*—Larry Jones

*Attorney, Agent, or Firm*—Richards, Harris, Medlock & Andrews

[57] ABSTRACT

A stage light instrument for providing efficient cooling of electrical components (40, 42) and a high wattage lamp (101). The facility includes a base enclosure (10) and a lamp enclosure (22) joined for pan and tilt movements by a forked hollow connecting member (14). The cylinder part (36) of the connecting member (14) is apertured and encased within the base enclosure (10) in bearings (65, 66) and in a plenum (34). A pair of tubes (68, 70) each with an air passage (72, 74) corporate with bearings (69, 71) to join the arms (18, 20) of the forked connecting member (14) to the lamp enclosure to provide air passage from the base enclosure (10) to the lamp enclosure (22). A fan (12) mounted in the base enclosure (10) draws air over electrical components (40, 42) and forces the air into the forked connecting member (14). Air is then routed through various ducts (86, 88, 98), hoods (120) and baffles (122) onto the high wattage lamp (101) and other lamp apparatus (90, 92, 112) housed within the lamp enclosure for cooling.

21 Claims, 4 Drawing Figures

VENTILATION SYSTEM FOR STAGE LIGHT INSTRUMENT

TECHNICAL FIELD

The present invention relates in general to ventilation systems, and more particularly relates to ventilation and cooling apparatus associated with stage lighting systems.

BACKGROUND ART

Substantial technological advances have been made in the stage lighting field. For example, it is not uncommon for a single stage light to include dimmers for light intensity control, color filter arrays for providing numerous colored lights, selectable gobo silhouettes, moveable lens assemblies, in addition to lamp pan and tilt actuators. Moreover, microprocessors have been utilized to maintain an account in RAM memory of the positional aspect of each of the features, as well to control the actuation of each of the noted features. Modern stage lights are controlled by large scale integration circuitry and feedback systems, not a lot unlike other processor-controlled apparatus.

Notwithstanding the many features which may be incorporated into a stage light, the primary purpose is to provide an intense beam of light onto the subject matter of a performance. Tungsten filament lamps have been found to operate very effectively in providing an intense light beam which is rich in colors over the visible light spectrum. This is essential when using filters so that various wavelengths may be selected to produce light beams of desired colors. Other types of lamps have been used with equal effectiveness.

According to commercially available lamps suitable for stage lighting purposes, a large filament current is required to produce a highly intense light beam. As a result, a substantial amount of power is consumed which must be dissipated as heat within the stage light. It is not uncommon to use a four hundred watt lamp in a stage light instrument. Of these four hundred watts of power used by the light, it is not unusual to generate two hundred watts of heat energy. It is also not uncommon for the immediate environment of such a stage lamp to reach a temperature of 250° C. (482° F.). This temperature is a result of the tungsten filament temperature which typically reaches 2900° C. Generally, with operating temperatures of this range, only quartz bulb envelopes can be used.

In addition to the heat generated by the high wattage lamp, additional heat is generated by power supplies and the digital circuitry. From the foregoing, the significance of an adequate, reliable and quiet operating cooling system can be appreciated. As a very real and practical danger, a failure in the cooling system of a stage light can literally result in the melting of the internal components of the lamp instrument.

One approach utilized for cooling a studio floodlight is illustrated in U.S. Pat. No. 3,959,644. In this patent, a pretensioned stainless steel tape is unwound from a reel into a cylindrical passage through which air is passed to cool the lamp. The complicated and expensive mechanical nature of the cooling system of the noted patent is not well adapted for reliable use, nor is such a structure cost effective for use in large systems having in excess of several hundred lamps.

From the foregoing, it may be seen that a need has arisen for a cost effective lamp instrument cooling system. There is an associated need for an improved cooling system in lamp instruments having sophisticated digital circuitry and associated power consuming apparatus.

SUMMARY OF THE INVENTION

In accordance with the present invention, a lamp instrument cooling system is provided which substantially eliminates or reduces the problems associated with the prior art techniques. In accordance with the invention, the lamp instrument is constructed with a base enclosure for housing the electronic and power supplies, and a fan for forcing air throughout the lamp instrument. A forked connecting member depends from the base enclosure and is mounted therein for swiveling movement. The connecting member is hollow and provides a passage to the base enclosure for communicating cooling air. A lamp enclosure is mounted for pivotal movement between the arms of the forked connecting member. The pivotal connection between the lamp enclosure and the forked connecting arms is constructed with passages therethrough for communicating cooling air to the lamp enclosure.

The forked connecting member includes a cylinder rotatable within the base enclosure to provide pan movements of the lamp enclosure. The cylinder is provided with a plurality of ventilation holes and is enveloped by a plenum which has an air passage to the fan. The airstream produced by the fan is thereby directed into the cylinder of the forked connecting member, and into the lamp enclosure through each hollow arm of the connecting member.

The apparatus mounted in the base enclosure is arranged so that the air drawn therein by the fan passes over the power supplies and the electronic circuit components. Ventilating air enters the lamp enclosure from the hollow forked connecting member and is directed into air distributing ducts which also serve a structural purpose in the lamp enclosure. One duct is provided with an opening, and with baffles for directing ventilation air onto the base and envelope of the high wattage lamp. In addition, the ventilation air is also directed to color filters, dimmers and the like disposed in the path of the light beam.

BRIEF DESCRIPTION OF THE DRAWINGS

The nature and construction of the present invention, along with the foregoing advantages and features thereof, will become more readily apparent from the following description of the disclosed embodiment, as shown with respect to the following drawings, in which.

DETAILED DESCRIPTION OF THE INVENTION

Figure 1:
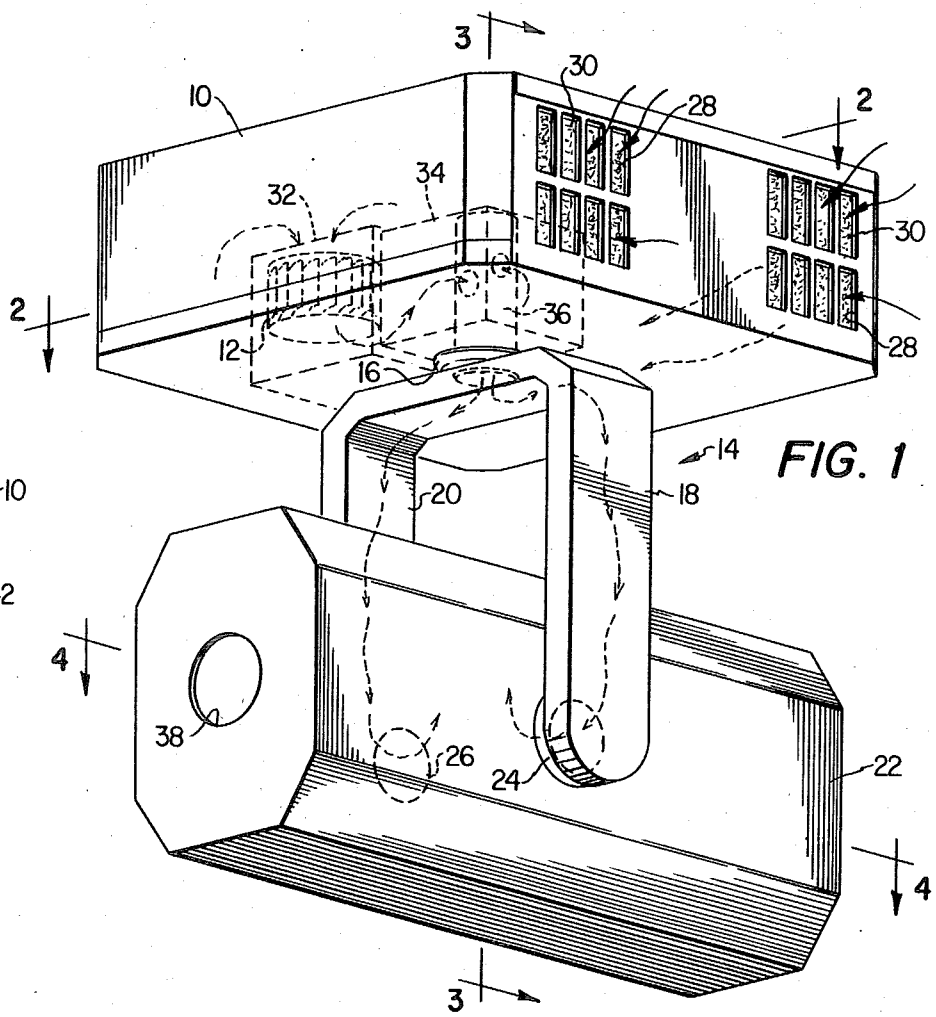
FIG. 1 is an isometric view of the lamp instrument, constructed in accordance with the invention.

The understanding of the invention is best understood by referring first to FIG. 1 of the drawings. The lamp instrument comprises primarily a base enclosure 10 for housing a fan 12 (shown in phantom) and the power supplies and electronics (not shown in FIG. 1). The base enclosure provides the support for mounting the lamp instrument by suitable hangers to overhead beams or rails.

A hollow forked connecting member 14 is provided with a swivel connection 16 to the base enclosure 10, and further includes a pair of hollow spaced-apart arms 18 and 20 depending downwardly therefrom. The swivel connection 16 enables pan movements. A lamp enclosure 22 is mounted for pivotal movement between arms 18 and 20 of the connecting member 14 by pivotal connections 24 and 26. Tilt movements of the lamp enclosure 22 are enabled by the pivotal connections 24 and 26. The pivotal connections 24 and 26 of the connecting member 14, as well as the swivel connection 16, are provided with passageways for providing the communication of ventilating air from the base enclosure 10 to the lamp enclosure 22.

The route taken by the air is shown generally by arrows in FIG. 1. Particularly, cool outside air is supplied to the base enclosure 10 through a plurality of inlets 28. The inlets 28 are grouped in a spaced-apart relationship for a purpose to be described below. The air is filtered by filters 30 before being drawn into the base enclosure 10 by a squirrel cage fan 12. A case 32 surrounding the fan 12 couples the air to a plenum 34. The fan case 32 is connected to the plenum 34 by a common passageway. The connecting member 14 is provided with an apertured cylinder 36 for communicating the air to the hollow forked arms 18 and 20. The cylinder 36 is enclosed by the plenum 34. From the cylinder 36, the air is forced by the fan 12 through the hollow arms 18 and 20, as well as through the passageways in the pivotal connections 24 and 26 to the lamp enclosure 22. As a result, ambient air is drawn from the outside of the lamp instrument into the lamp enclosure 22 for cooling the high-wattage lamp therein. Air that has absorbed the heat energy of the lamp is exhausted from the lamp enclosure 22 through a spotlight opening 38 and through louvered vents 39 (shown in FIG. 4) at the opposite end. Pan pulley 37 is mounted on cylinder 36 to pan lamp enclosure 22 with a motor (not shown) in base enclosure 10 acting to rotate pulley 37 (shown in FIG. 3) and cylinder 36 through a drive belt 150 (shown in FIG. 3).

Figure 2:
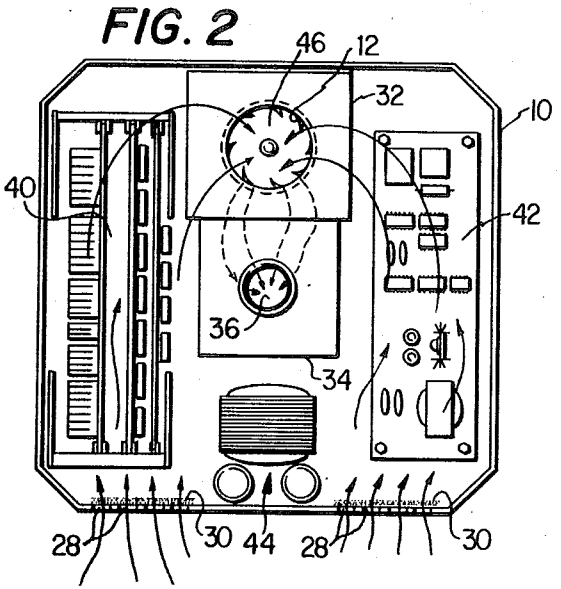
FIG. 2 is a sectional view of the base enclosure, taken along line 2—2 of FIG. 1.

FIG. 2 illustrates the arrangement of the equipment within the base enclosure 10 of the lamp instrument. As noted in the figure, the fan 12 is located within the base enclosure on a side opposite the air inlets 28. Importantly, circuit modules, generally designated 40, and power supply equipment 42 are located between the air inlets 28 and the fan 12. With this placement, cool outside air drawn into the base enclosure 10 by the fan 12 must necessarily pass over the electronic modules 40 and the power supplies 42. The heat generating apparatus is thereby cooled.

After the outside air has passed over the circuit module 40 and power supplies 42, such air is drawn into the fan 12 and communicated to the lamp enclosure 22 in the manner noted above. The cooling of the circuit modules 40 and the power supplies 42 elevates the air temperature about 20° C. above the ambient air temperature. This cooling extends the life of the electrical components, and the temperature rise of the air does not have a significant effect on the cooling of the high wattage lamp. This can be appreciated as the bulb of the lamp operates at about 250° C.

As noted in FIG. 2, the fan 12 is enclosed by a case 32, except for an opening 46 at the entrance of the center of the squirrel cage. The low air pressure generated within the squirrel cage as a result of its rotation causes air to be drawn into the fan case 32. From the case 32 of the fan 12 the air is forced into the plenum 34 surrounding the cylinder 36 of the connecting arm 14. Air is forced from the plenum 34 into the cylinder 36 through holes in the cylinder.

Figure 3:
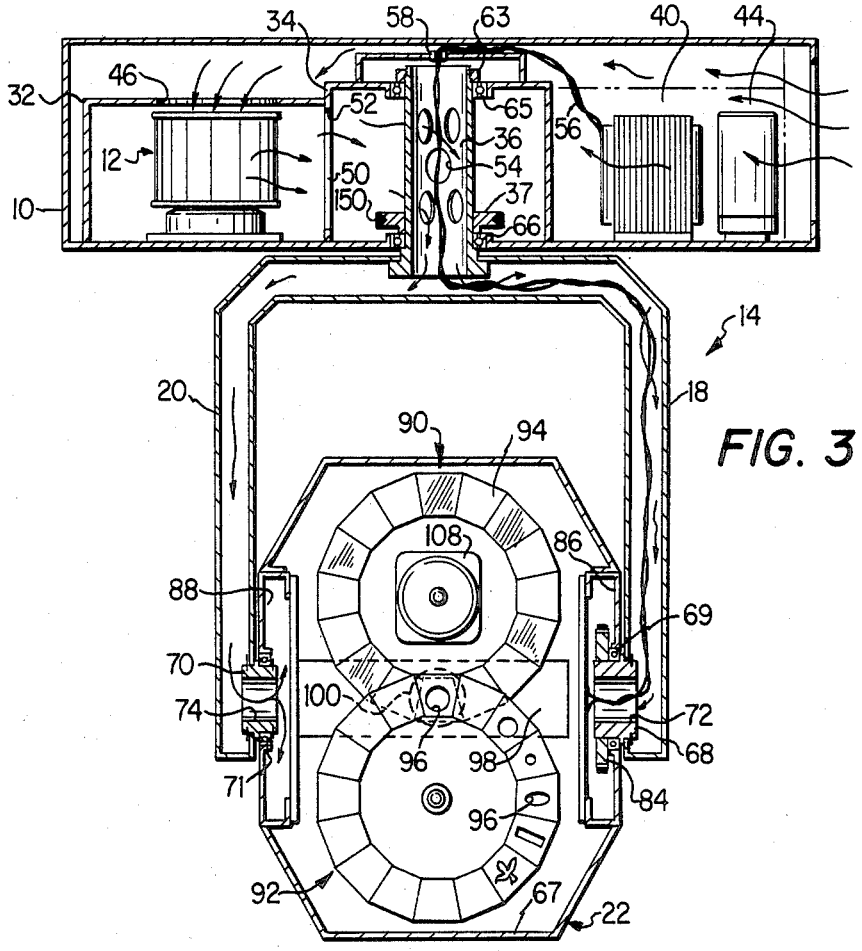
FIG. 3 is a sectional view of the lamp instrument taken along line 3—3 of FIG. 1 and illustrating the passageway of the airflow from the base enclosure to the lamp enclosure.

Referring now to FIG. 3, there is shown a different view of the communication of the air from the fan 12 to the forked connecting member 14. A divider 50 forms a common wall between the case 32 of the fan 12 and the plenum 34. The passage 52 in the divider 50 allows air to be transferred from the case 32 into the plenum 34. A plurality of holes 54 are cut or formed into the connecting arm cylinder 36. Accordingly, air forced from the fan 12 is directed through the holes 54 and into the central part of the cylinder 36. From the central part of the cylinder 36, air is forced into each forked arm 18 and 20 of the connecting member 14.

FIG. 3 also illustrates an electrical cable 56 which is routed through the plenum 34 by a grommet 58, or other strain relief device. The cable 56 is routed through the top of the cylinder 36 and down through the cylinder. In this manner, electrical cable 56 allows a back-and-forth panning motion of the lamp enclosure 22. The plenum 34 is constructed of a heavy gauge lightweight metal, such as aluminum, and welded to the bottom of the base enclosure 10.

The forked connecting member 14, and thus the lamp enclosure 22, is provided with a pan motion about a vertical axis. The weight of the member 14 and lamp enclosure 22 is supported through a retaining ring 63 secured on cylinder 36. The pan motion is made possible by providing a pair of vertically spaced ball bearings 65 and 66 between the cylinder 36 of the connecting member 14 and the base enclosure 10. The connecting member 14 is fixed to the cylinder 36, while the cylinder 36 is rotatable with respect to the base enclosure 10. With the provision of the two bearings 65 and 66, an additional degree of stability is provided the lamp enclosure 22 with respect to the base enclosure 10, while yet allowing swivel or pan motions.

Continuing with FIG. 3, the lamp enclosure 22 is mounted between the arm 18 and 20 of the forked connecting member 14 for pivotal movement about a horizontal axis. This corresponds to a tilt axis of the lamp facility. Fixed to the arms 18 and 20 are a pair of tubes 68 and 70 having passageways 72 and 74 formed centrally therethrough. The outer races of ball bearings 69 and 71 are fixed to the shell 67 of enclosure 22. The inner races are fixed to the tubes to support enclosure 22 for tilt motion. The tilt motion of the lamp enclosure 22 thereby moves the bearings 69 and 71 with respect to the forked connecting member 14. Also fixed to tube 68 is a toothed pulley 84 for use in effecting the tilting motion of the lamp enclosure 22.

The portion of the enclosure 22 supporting the bearings 69 and 71 on the lamp enclosure 22 form a corresponding pair of ducts 86 and 88. These ducts 86 and 88 receive the air forced through the forked connecting member arms 18 and 20 and direct the ventilating air to desired apparatus within the lamp enclosure 22. In addition, the ducts are also integral to the structure of enclosure 22. As noted above, because of the intense beam of light produced by the high wattage lamp, those parts of the lamp facility which operate upon the beam of light to provide color, dimming, etc., become extremely hot, and thereby require cooling.

In FIG. 3, there is shown a rotatable color wheel 90 and a gobo wheel 92, each with peripheral elements 94 which are overlappable at a position shown by 96. The position 96 is the point at which the beam of the high intensity lamp converges and passes through the elements. In order to prevent an excessive build up of heat within the wheels 90 and 92, the focal point 96 must be cooled. A transverse duct 98 is mounted to air duct 88, and is in communication therewith by a port (not shown in FIG. 3). Also, transverse duct 98 includes an opening 100 proximate the focal point 96, wherein the wheels 90 and 92 receive ventilation air proximate the passage of the light beam. Of course, the opening 100 prevents the light beam from being blocked by the transverse duct.

Figure 4:
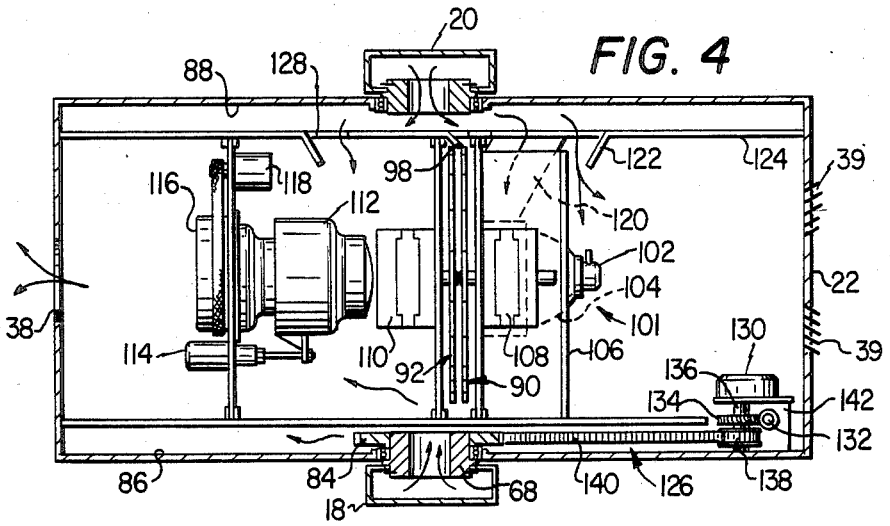
FIG. 4 is a sectional view of the lamp enclosure, taken along line 4—4 of FIG. 1, and illustrating the baffle for directing air on the various lamp apparatus.

In FIG. 4, the transverse duct 98 is shown opening into the side air duct 88. In addition, there is shown a high wattage lamp 101 having a base 102 and an envelope 104. A thermal shield 106 overlies the lamp to thermally insulate a stepper motor 108 of color wheel 90 from the heat of the lamp 101. A stepper motor 110 is similarly provided to rotate the gobo wheel 92 in increments. An objective lens 112 is placed in the path of the light beam for providing a focused beam of light. A motor 114 is connected to the object lens 112 for adjustably moving the lens 112 in an axial direction with respect to the light beam. A dimmer 116, in the nature of a mechanical iris, is provided for adjusting the intensity of the beam of light produced by the lamp 101. A motor 118 is operative to adjust the opening within the iris 116 and thereby change the intensity of the light beam.

A hood 120 is connected to the side air duct 88. A passageway for air is provided between the side air duct 88 and the hood 120, thereby diverting a portion of the air forced into side air duct 88 toward the high wattage lamp 101. Because the hood 120 is directed to the frontal portion of the lamp 101, a large amount of heat is removed therefrom, as well as from closely located apparatus. A baffle 122 is formed within the sidewall 124 of side air duct 88 for directing air to cool the base 102 and envelope 104 of the lamp 101. The baffle 122 is essentially a portion of the air duct sidewall 124 cut into a tab and bent outwardly for diverting air within the side air duct 88 toward the lamp 101. Side air duct 86 opens into the lamp enclosure 22 at position 126. Also, the baffle 128 is provided for directing air toward the object lens 112. Air forced from the side air ducts 86 and 88 into the lamp enclosure 22 is exhausted to the outside by the spotlight opening 38 and rear louvers 39.

A tilt motor 130 is provided with a worm gear 132 for driving a sprocket 134 fixed to shaft 136. Fixed also to the shaft is a pulley 138 which is coupled by a belt 140 to the toothed gear 84. The motor 130 is fixed to the lamp enclosure 22 by a bracket 142. As a result, when motor 130 is energized, the pulley 138 rotates slowly, thereby rotating the housing 22 around the forked connecting member arms 18 and 20.

From the foregoing, an improved lamp enclosure and ventilating system is disclosed. The heat and noise generating equipment, such as the power supplies, circuit modules and fan is mounted in the base enclosure of the lamp instrument. The fan draws air into the base enclosure and over the electrical equipment to cool it. A hollow forked connecting member is anchored within the base enclosure using bearings for rotation about a vertical axis. The lamp enclosure houses the high wattage lamp and the optical equipment for creating special effects. The lamp enclosure is fixed between the arms of the forked connecting member by bearings for providing tilt movements of the lamp enclosure. The bearings have passageways formed therethrough for communicating ventilating air from the base enclosure through the forked connecting member, and to the inner portion of the lamp enclosure. Ventilating air is distributed within the lamp enclosure by a pair of ducts, and various hoods and baffles. Air is also forced over the envelope and base of the high wattage lamp, thereby removing a significant amount of heat generated therein. The heated air which is forced through the lamp enclosure and the louvers at the rear of the lamp enclosure is exhausted through the lamp enclosure opening through which the beam of light exits the instrument.

Although the preferred embodiment of the invention has been described in detail, it should be understood that various changes, substitutions and alterations can be made therein without departing from the spirit and scope of the invention as defined by the appended claims. For example, those skilled in the art may prefer dual fans for separately cooling the base enclosure apparatus and the high wattage lamp.

I claim:

1. A stage light instrument having a lamp, comprising:

an apertured base enclosure for stationary mounting;

an apertured lamp enclosure for containing a light source;

a hollow connecting member connecting said base enclosure to said lamp enclosure;

swivel means for connecting said hollow member to said base enclosure, and for defining a bearing assembly for allowing swivel movement of said lamp enclosure about a first axis, said bearing assembly having a passage providing the communication of air from said hollow connecting member to said base enclosure;

pivotal means for connecting said hollow member to said lamp enclosure and for defining a bearing assembly allowing pivotal movement of said lamp enclosure about a second axis, said bearing assembly having a passage providing the communication of air from said hollow connecting member to said lamp enclosure; and means including a fan for forcing air through said base enclosure, said connecting member, said bearing assemblies, and said lamp enclosure.

2. The stage light facility of claim 1 wherein said hollow connecting member includes a forked part mounted to opposing sides of said lamp enclosure.

3. The stage light facility of claim 1 further including a power supply for supplying power to said lamp, said power supply being mounted in said base enclosure substantially between the aperture therein and said fan, and wherein said fan is operative to draw air into said base enclosure.

4. The stage light facility of claim 3 further including an apertured case around said fan, the apertures thereof being disposed in the case so as to circulate air around said power supply.

5. The stage light facility of claim 4 further including means for directing air outside said stage light facility first over said power supply, and then over said lamp.

6. The stage light facility of claim 1 further including an air duct in said lamp enclosure, one end of said air duct being in communication with said connecting member, and the other end being directed toward the lamp.

7. The stage light facility of claim 6 wherein said air duct includes a first baffle directing air onto the base of the lamp, and a second baffle directing air onto the envelope of said lamp.

8. A stage light instrument having a lamp, comprising:

an apertured base enclosure for stationary mounting;

an apertured lamp enclosure for containing a light source;

a hollow connecting member connecting said base enclosure to said lamp enclosure; swivel means for connecting said hollow member to said base enclosure, and for allowing swivel movement of said lamp enclosure about a first axis, said swivel means having a passage providing the communication of air from said hollow connecting member to said base enclosure;

pivotal means for connecting said hollow member to said lamp enclosure and for allowing pivotal movement of said lamp enclosure about a second axis, said pivotal means having a passage providing the communication of air from said hollow connecting member to said lamp enclosure;

means for forcing air through said base enclosure, said connecting member and said lamp enclosure;

said hollow connecting member including a forked part mounted to opposing sides of said lamp enclosure; and wherein said hollow connecting member includes a cylinder part extending substantially within said base enclosure.

9. The stage light facility of claim 8 wherein said cylinder part is apertured for allowing the passage of air therethrough.

10. The stage light facility of claim 9 further including a plenum enclosing that part of the cylinder part within the base enclosure, said plenum having an aperture for communicating air therethrough.

11. The stage light facility of claim 8 wherein said hollow connecting member swivels within said base enclosure, and swivels about two spaced-apart locations on said cylinder part.

12. An enclosure and cooling system for housing components of a stage light instrument, comprising:

a base enclosure having an air inlet and an air outlet;

a tubular connecting member having an apertured portion, said apertured portion being disposed within said base enclosure through the air outlet;

first bearing means connecting said connecting member to said base enclosure for providing swivel movements of said tubular connecting member with respect to said base enclosure;

a lamp;

a lamp enclosure for housing said lamp and having an air inlet and an air outlet;

second bearing means having a passage therethrough for fixing said tubular connecting member to the air inlet of said lamp enclosure so that air can pass from said connecting member into said lamp enclosure, said bearing means allowing pivotal movement of said lamp enclosure with respect to the tubular connecting member; and means for forcing air into the air inlet of said base enclosure through said connecting member and out the lamp enclosure outlet.

13. The enclosure and cooling system of claim 12 further including a plenum in said base enclosure for enclosing the apertured part of said tubular connecting member, said plenum also housing said means for forcing air and having an input port through which air is drawn into said plenum.

14. The enclosure and cooling system of claim 13 wherein said first bearing means comprises a first and second axially aligned bearings.

15. The enclosure and cooling system of claim 13 wherein said tubular connecting member is centrally located in said base enclosure, and the input port of said plenum is spaced apart from the base enclosure air inlet, and further including an electrical component fixed in said base enclosure between the base enclosure air inlet and the plenum input port, whereby air circulated by said air forcing means is passed over said electrical component and thereby cooled.

16. The enclosure and cooling system of claim 15 wherein said air forcing means comprises a fan which is arranged so as to circulate air first over said electrical component, and thereafter over said lamp.

17. The enclosure and cooling system of claim 12 further including a duct fixed in said lamp enclosure and disposed over the passage of said second bearing means, said duct being operative to direct air from said tubular connecting member toward said lamp.

18. The enclosure and cooling system of claim 17 further including hood means joined to said duct for directing air to a frontal part of said lamp.

19. The enclosure and cooling system of claim 18 further including a baffle adjacent an opening in said duct and angled so as to direct air to an envelope and a base part of said lamp.

20. A stage light instrument having a lamp and circuitry producing heat, comprising:

a base enclosure having an interior, the circuitry mounted in the interior of the base enclosure, said base enclosure further having an aperture permitting air to enter the interior of the base enclosure;

a lamp enclosure having an interior, the lamp being mounted in the interior of said lamp enclosure, said lamp enclosure having means for passage of air between the interior and exterior of the lamp enclosure, said lamp enclosure having at least one air duct defined by structural elements of said lamp enclosure for distributing air to the interior of the lamp enclosure at selected locations;

a hollow connecting member connecting said base enclosure to said lamp enclosure, the interior of said hollow connecting member opening into the interior of the base enclosure and the air duct in the lamp enclosure; and means for forcing air from exterior the stage light instrument over the circuitry to cool the circuitry, through said hollow connecting member and into the air duct for distribution within the interior of the lamp enclosure to cool the lamp prior to being exhausted exterior of the stage light instrument.

21. The stage light instrument of claim 20 wherein said lamp enclosure is provided with means for forming a duct to direct air from the hollow connecting member over the lamp for cooling, said duct means also providing a structural support to the lamp enclosure.

* * * * *